United States Patent [19]

Martin et al.

[11] Patent Number: 4,570,548

[45] Date of Patent: Feb. 18, 1986

[54] SECURE CONTAINER AND ACTUATOR FOR A SHEET DISPENSING APPARATUS

[75] Inventors: Harvey G. Martin, Sussex; Nicholas A. Bruin, Hampshire, both of England

[73] Assignee: De La Rue Systems Limited, London, England

[21] Appl. No.: 703,533

[22] Filed: Feb. 20, 1985

[30] Foreign Application Priority Data

Feb. 20, 1984 [GB] United Kingdom ..... 8404364

[51] Int. Cl.[4] ..... E06B 7/32; E05G 3/00

[52] U.S. Cl. ..... 109/66; 221/197; 220/260; 271/162; 109/24.1; 109/44

[58] Field of Search ..... 221/197, 281, 282, 2, 221/4, 8, 247, 21, 198; 194/DIG. 26; 271/145, 149, 162, 164; 242/198; 109/44, 24.1, 66, 21, 38, 39; 220/260; 49/35; 74/43 R

[56] References Cited

U.S. PATENT DOCUMENTS

| | | | |
|---|---|---|---|
| 4,235,433 | 11/1980 | Hirata | 221/197 X |
| 4,275,667 | 6/1981 | Hilton | 109/39 X |
| 4,283,097 | 8/1981 | Lundblad | 271/145 X |
| 4,438,704 | 3/1984 | Hutcheon | 109/44 |
| 4,442,781 | 4/1984 | Fish | 109/24.1 X |
| 4,508,260 | 4/1985 | Keir et al. | 109/38 X |

FOREIGN PATENT DOCUMENTS

| | | |
|---|---|---|
| 2016421 | 9/1979 | United Kingdom . |
| 2121472 | 12/1983 | United Kingdom . |

*Primary Examiner*—Joseph J. Rolla
*Assistant Examiner*—Gregory L. Huson
*Attorney, Agent, or Firm*—Cushman, Darby & Cushman

[57] ABSTRACT

In apparatus for dispensing documents of value for example banknotes, a cassette (10) preloaded with a stack of banknotes is movable along a predetermined path into the dispenser housing up to a feed position; the cassette includes a shutter (18) for closing a feed aperture (22) through which banknotes can be extracted for dispensing. The dispenser housing has a stop member (40) movable by a cam (30) on the cassette to cause a shutter-actuating member (42), coupled to the stop member, to enter a recess (26) in the shutter (18) whereby during further movement of the cassette up to the document feed position the shutter is moved from its closed position to its open position. The relative position of the cam on the cassette and the stop member is such that if because the shutter is already open the shutter-actuating member (42) is prevented from entering the recess, further movement of the cassette into the housing is blocked by the continued engagement of the stop member (40) and the cam (30).

8 Claims, 7 Drawing Figures

SECURE CONTAINER AND ACTUATOR FOR A SHEET DISPENSING APPARATUS

This invention relates to apparatus for dispensing documents of value, for example banknotes, including a housing and a secure container which is movable along a predetermined path into and out of the housing to and from a document feed position, the container being preloaded with a stack of the documents to be dispensed.

An example of the cassette for use in such dispensing apparatus is shown in the published British Patent Specification No. 2039264A. In this specification, there is described a cassette having a pivoted lid allowing a stack of banknotes to be loaded into the cassette, and having a shutter which, when closed, covers an aperture which otherwise give access to the front of the note stack. In the construction described, the housing into which the cassette is inserted contains two long parallel actuating rods which, when the cassette is inserted into the housing, enter holes in the base of the cassette and contact lugs fixed to a shutter operating member, so that when the cassette has been fully inserted its shutter will have been fully opened as a consequence of the engagement of the actuating rods and the lugs.

This shutter operating mechanism works well but is rather expensive to manufacture and requires precise alignment of the actuating rods with the holes in the cassette.

An object of the present invention is to provide a simpler way of opening the shutter as the cassette is inserted into the housing.

The present invention consists in apparatus for dispensing documents of value, comprising a housing and a container for a stack of documents, the container being movable along a predetermined path into the housing up to a document feed position, and including a closure device for closing a feed aperture giving access to the stack; the housing having a dispensing outlet, document feeding means for transferring documents from the feed aperture of the container to the dispensing outlet, a stop member movable into and out of the path of the container and an actuator for the closure device, coupled to the stop member, for opening the closure device during insertion of the container into the housing; the closure device and the actuator and coupled stop member being so formed and arranged for cooperation that when the container is inserted, if the closure device is in a closed state the actuator engages and opens the closure device during the insertion and the stop member lies clear of the path of the container, and if the closure device is already open the actuator co-operating therewith is so positioned that the stop member lies in the path of the container and prevents full insertion of the container.

The closure device may have a recess accessible to the actuator in the housing and the container may be formed with camming means for engaging the stop member in the housing, when the container reaches a given point during its insertion into the housing, to move the actuator into a position in which it enters the recess in the closure device and to move the stop member clear of the camming means. In this preferred form, the actuator is mounted on a bar which is mounted in the housing to pivot about an axis perpendicular to the direction of movement of the container into the housing, the actuator lying over the path of the recess, and the stop memeber being mounted on the bar at the side of the path of the container for engagement by the camming means arranged on the side of the container, the actuator entering the recess in the closure device when it is pivoted by the engagement of the stop member with the camming means.

The invention also consists in a container for documents of value, for use in apparatus of the kind described above, and including a closure device so arranged that when the container is in its closed condition, a part of the closure device lies over a feed opening in the front of the container and a further part lies along a face of the container perpendicular to the front opening, the further part including a recess accessible to and engageable by an external member to open the closure device, the container further comprising camming means formed at an outer surface of the container. The closure device may comprise an articulated shutter and the container may be provided with a lid for closing a top opening through which a stack of documents can be loaded into the container, the lid being formed with a slot giving access to the said further part of the shutter containing the recess and being formed to support the shutter when the shutter is retracted to its fully open position. The shutter locks the lid to the container when the shutter is closed.

In order that the invention may be better understood, an example of apparatus embodying the invention will now be described with reference to the accompanying drawings, in which.

Figure 3A:
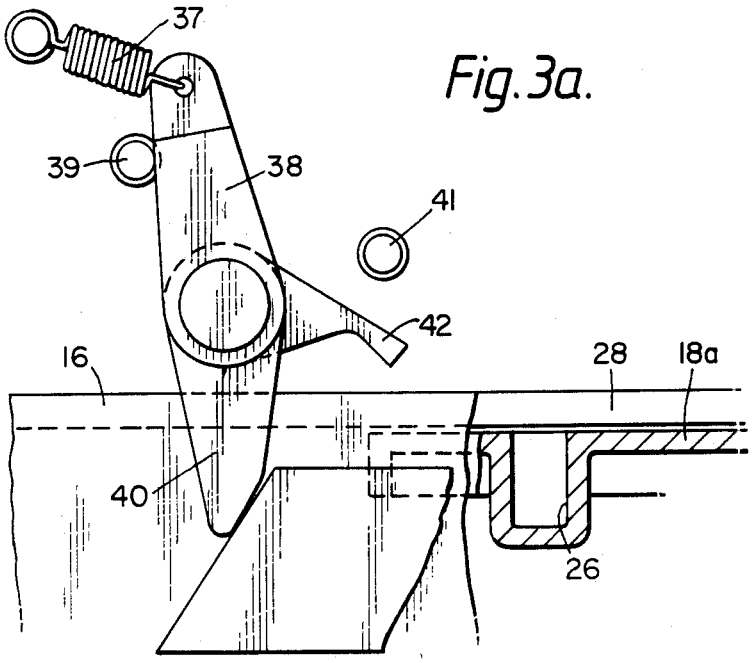
Figure 3B:
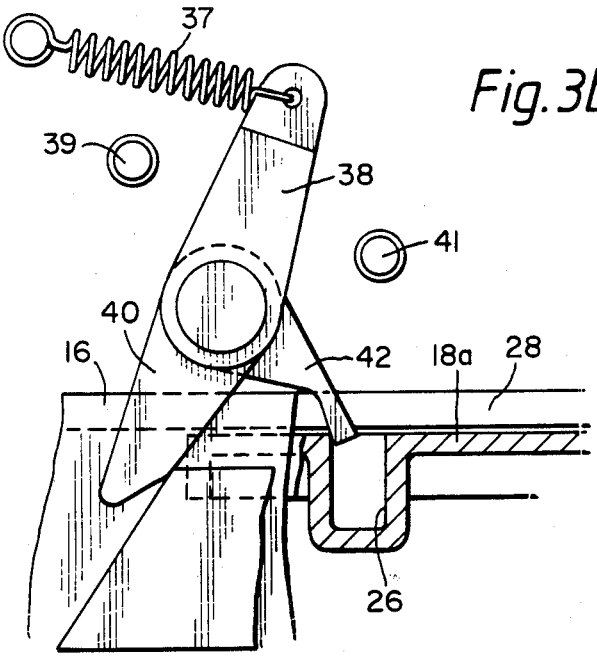
Figure 3C:
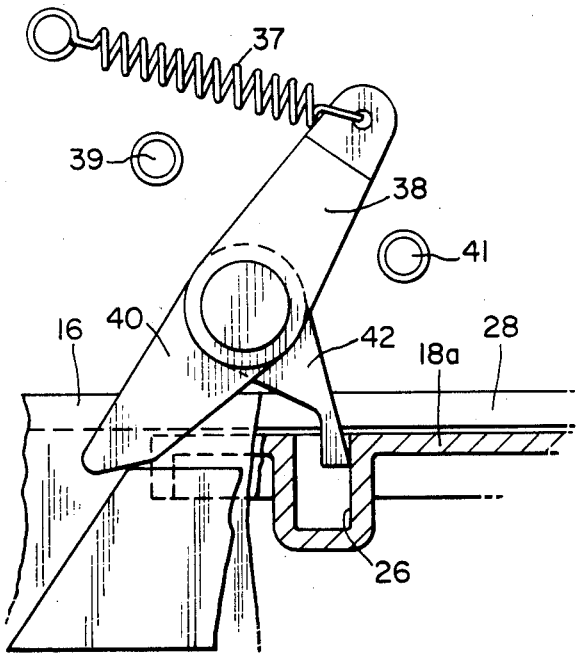
Figure 4:
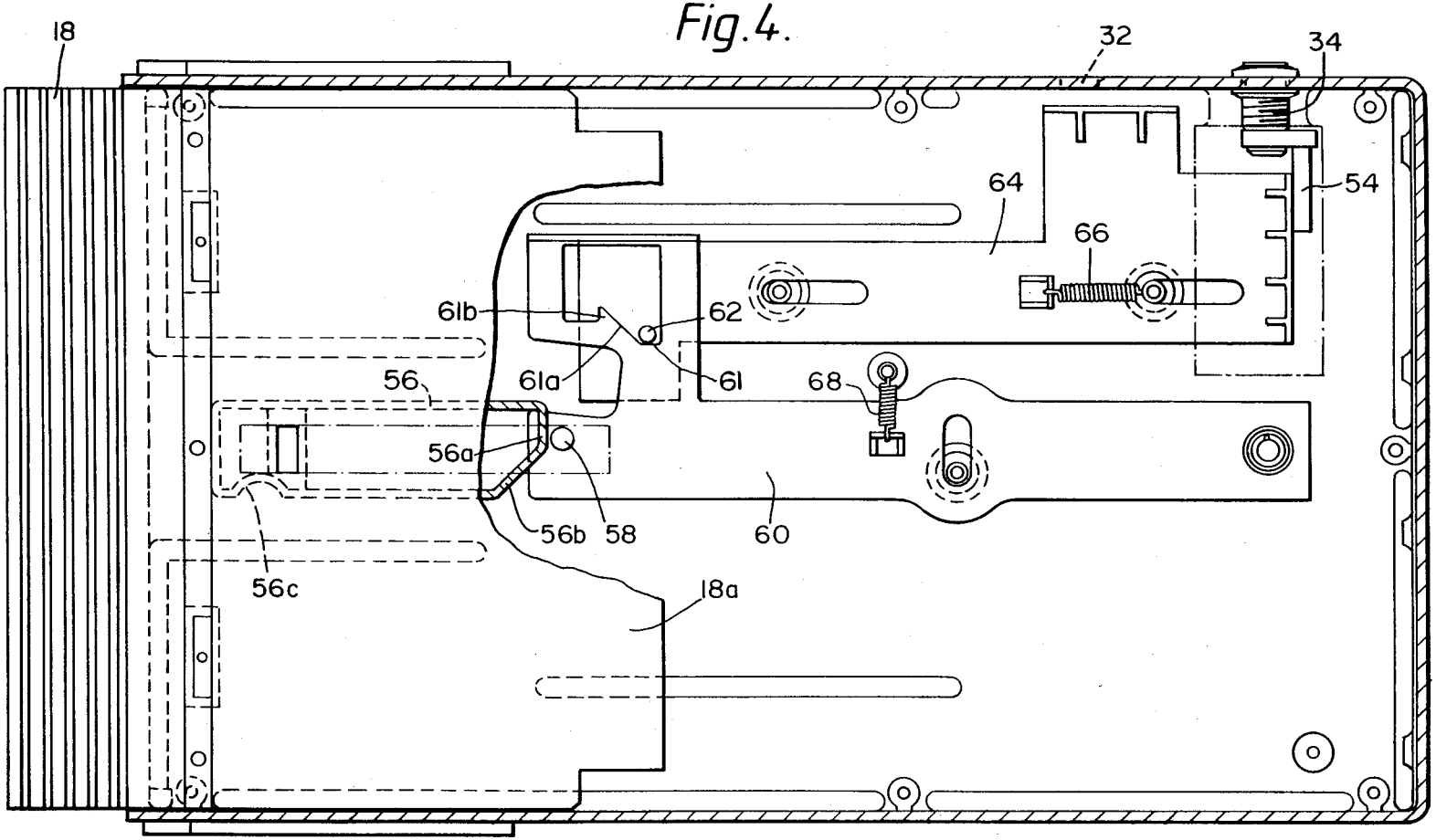
Figure 5:
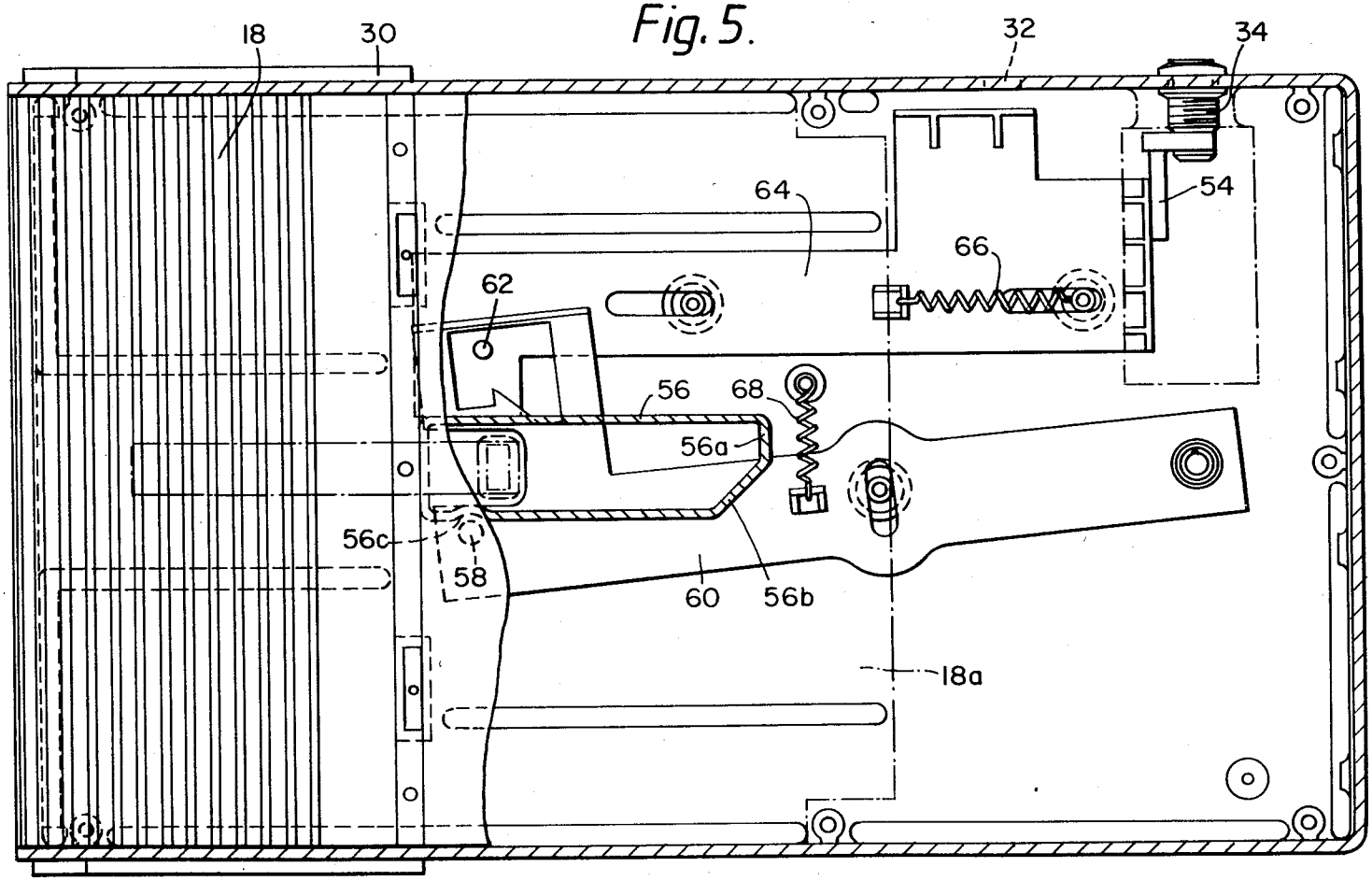

FIGS. 3*a*, 3*b* and 3*c* illustrate diagrammatically the operation of the shutter operating bar;

FIG. 4 is a sectional plan view of the lid with the shutter in a closed and locked position; and FIG. 5 is a sectional plan view of the lid with the shutter in an open position.

Figure 1:
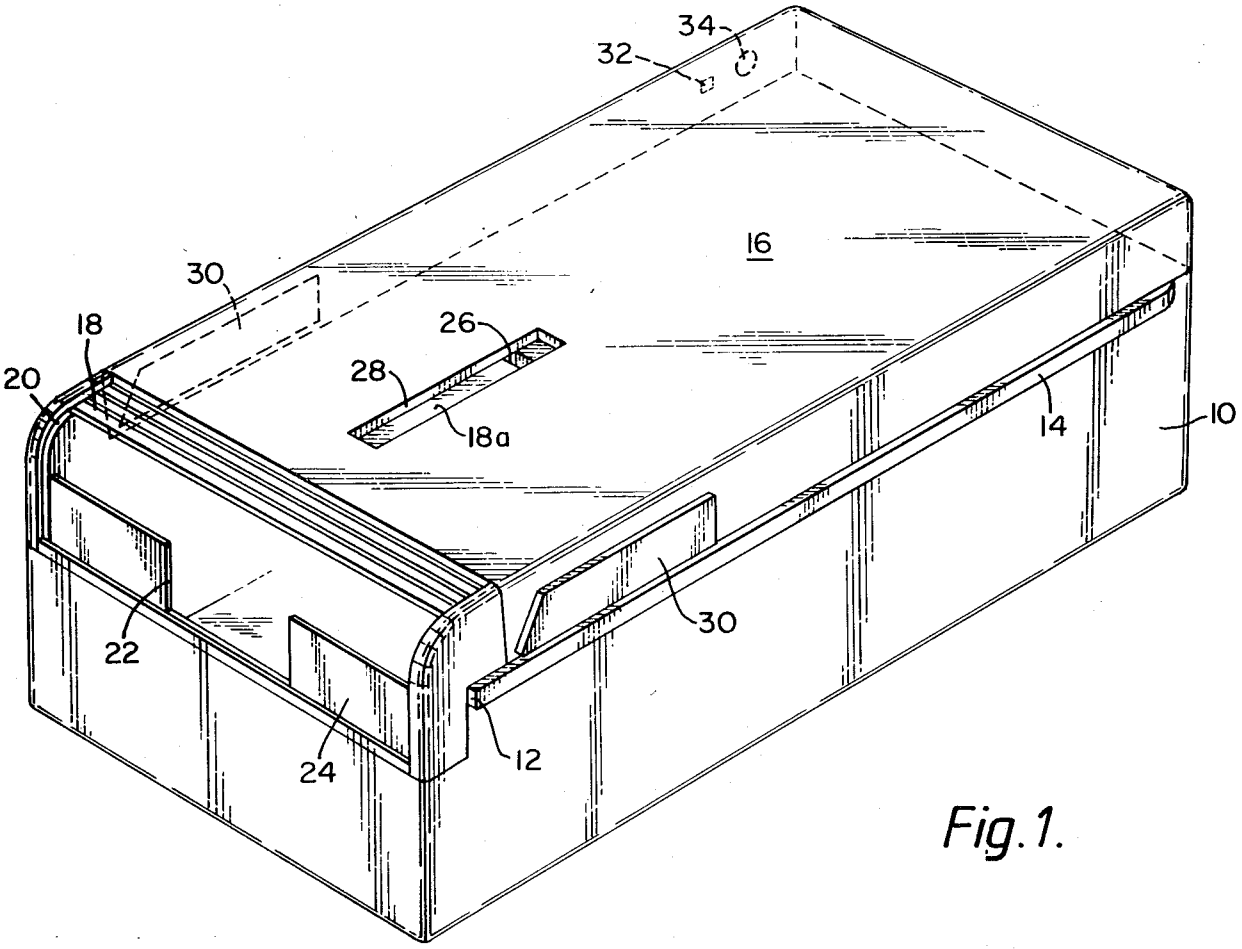
FIG. 1 is a perspective view of a cassette for use in the apparatus.

In FIG. 1, a cassette body 10 is provided with slides 12 and 14 for engagement with supports in a housing of the dispensing apparatus, to enable the cassette to be slid from the rear of the housing to a note dispensing position towards the front of the housing. The cassette is provided with a lid 16 which is raised when it is required to load the cassette with a stack of notes.

The cassette is also provided with a shutter 18 movable along tracks 20 in side plates of the cassette to close a feed aperture at the front of the cassette or to give access at the feed aperture to the front note in the stack. To feed the front note, with the shutter open, a feed device engages the front note through a recess 22 in a feed plate 24 and transfers the note to a sheet transport system. A shutter extension 18*a* is formed with an actuation slot 26 which is accessible through a slot 28 in the lid 16. Finally, the cassette is formed with a shutter bar cam 30, the purpose of which will be explained in connection with FIG. 2; a flag window 32 through which a red or green flag, indicating the state of the shutter, can be seen; and a lock 34.

Figure 2:
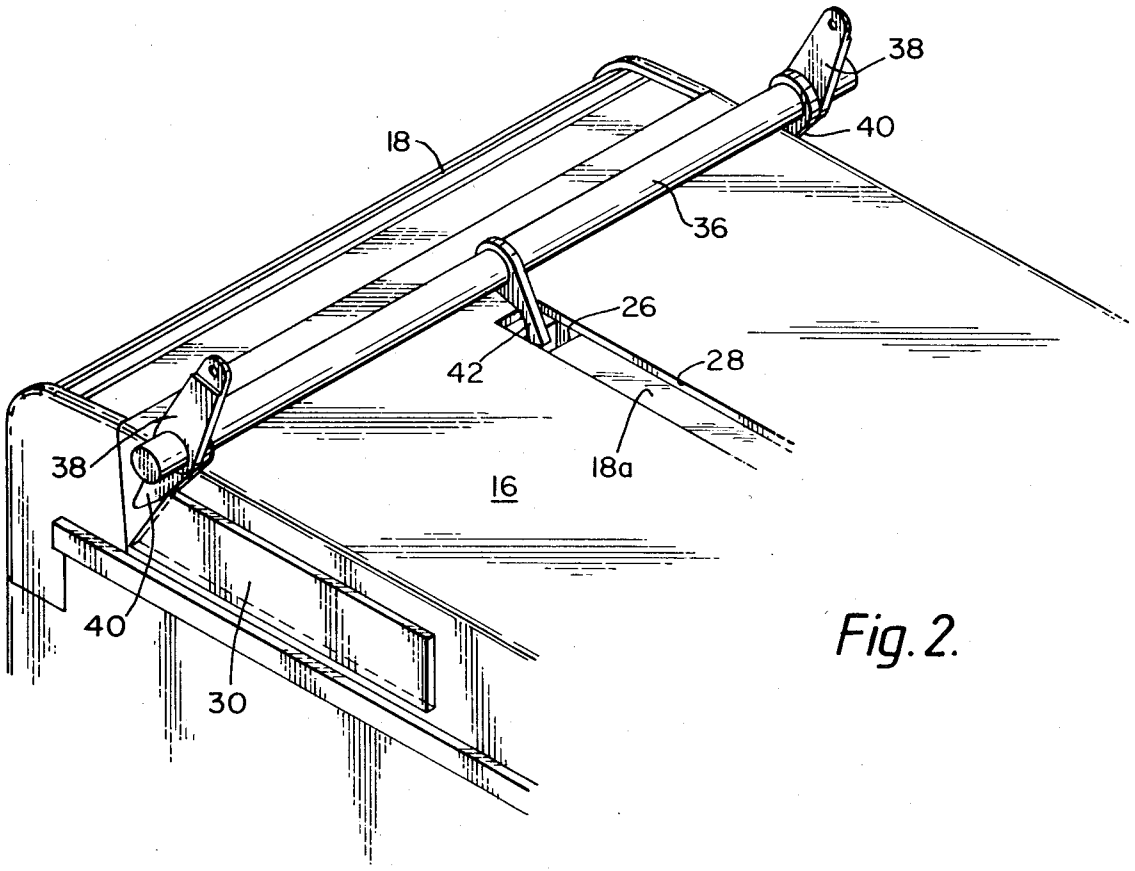
FIG. 2 shows a part of the cassette on an enlarged scale and a shutter operating bar which is pivotally mounted in the housing.

FIG. 2 illustrates the cooperation between the shutter of the cassette and a shutter-operating bar 36 pivotally mounted at its ends on side plates in a housing, into which the cassette is to be inserted. An actuator 42 is provided on the bar for co-operation with the slot 26 in the shutter extension 18*a*.

The shutter opening and closing operations will now be explained. When a shutter cocking mechanism, which will be more fully described with reference to FIGS. 4 and 5, has been primed to allow movement of the shutter, the cassette is inserted into the housing with the shutter closed. The shutter operating bar 36 straddles the path of insertion of the cassette into the housing and initially during the insertion of the cassette the central offset portion of the shutter operating bar does not contact the cassette.

However, when the insertion of the cassette reaches a point at which the shutter bar cam 30 contacts a lower lug 40 attached to the shutter operating bar, the cam 30 causes the shutter operating bar to pivot clockwise (FIGS. 2 and 3) against the action of a spring 37 (FIG. 3) attached to an upper lug 38 fixed to the bar 36. The upper lug 38 is movable between stops 39 and 41. The bar 36 is pivoted by the cam to a position in which the actuator 42 passes through the slot 28 in the lid 16 of the cassette and enters the actuation slot 26 of the shutter extension 18*a*. Thereafter, the shutter is prevented from moving with the cassette as the cassette is further advanced to its feed position, with the result that during this advancement the shutter progressively uncovers the feed opening 22 of the cassette. The shutter is illustrated in its position prior to pivoting in FIG. 3*a*, and in its position when the actuator 42 has engaged the shutter actuating slot in FIG. 3*c*. FIG. 3*b* represents an intermediate position. If the shutter has been opened prior to insertion of the cassette into the container, the recess in the shutter extension will not then be in a position to receive the actuator 42 of the shutter operating bar and instead the actuator 42 will rest on the surface of the shutter extension. With the shutter operating bar so positioned, further movement of the cassette towards its feed position will be prevented because the lower lug 40 on the shutter operating bar does not completely clear the cam 30 (FIG. 2). Thus, insertion of the cassette cannot be effected with the shutter open.

The cocking mechanism and the means for ensuring that the shutter remains in its retracted (open) position when the lid is open, are shown in FIGS. 4 and 5. The shutter cocking mechanism is controlled by a lock 34 with a pin 54. In the position shown in FIG. 4, the shutter 18 is prevented from moving to the right because an end 56*a* of a member 56 attached to the shutter extension 18*a* abuts against a stop pin 58 on a pivoted member 60. The member 60 is prevented from moving by a tension spring 68, which urges the pivoted member 60 in a clockwise direction, and by the engagement of a portion 61 of the pivoted member 60 with a pin 62 on a slide 64. The slide 64 is held by a spring 66 against the lock pin 54. The window 32 provided in a side wall of the lid enables one of two flags, a red flag and a green flag to be seen. The flags are attached to the slide 64. In the position of FIG. 4 the red flag is seen, indicating that the shutter mechanism is not cocked.

If now the key holder wishes to insert the cassette into a container and to allow its shutter to open in the process, he turns the lock 34 through 180° so that the pin 54 reaches the position shown in FIG. 5. During this movement of the pin, the slide 64 is moved to the left, against the force of the spring 66. The engagement of the pin 62 on the slide with the cam surface 61*a* of the member 60 causes the member 60 to pivot anti-clockwise until the pin 62 drops in behind the projection 61*b* of the member 60. The angular position of the member 60 is then such that pin 58 is aligned with an oblique surface 56*b* of the member 56 attached to the shutter extension.

The mechanism is now cocked and the lock is returned through 180° and the key is removed. In the cocked position of the mechanism, the green flag shows through the window 32 and the shutter 18 is free to move.

If the cassette is now inserted into its container housing, the shutter will be retracted (i.e. will move to the right in FIG. 4) to open the feed aperture of the cassette as previously explained. With such retraction, the oblique end 56*b* of the member 56 engages the pin 58 and forces the member 60 to pivot further anti-clockwise to the position shown in FIG. 5. At the same time, the slide 64, free from the restraint imposed by its engagement with projection 61*b*, slides to the right under the force of the spring 66 so that the red flag is shown again through the window 70. With the opening of the shutter, the member 56 moves over the pin 58 until the pin 58 engages in a detent 56*c* at the end of the shutter movement.

When the cassette is removed from the container housing, the shutter is returned by the actuator 42 on the shutter operating bar to a closed position. During this return movement, the pin 58 rides out of the detent 56*c* and along the oblique surface 56*b* until it reaches its original position (FIG. 4) in alignment with the end 56*a*.

It is not possible to open the shutter again without a further operation of the key. Thus, the mechanism allows the shutter to be opened once only for each full motion of the lock and the indication in the window 32 changes from green back to red as soon as the shutter is moved and before notes are exposed.

Although we have described a pivoted shutter-operating bar having a shutter actuator for entering a recess in the shutter and downwardly extending lugs at the side of the cassette path to be engaged by cams on the cassette sides it will be understood that variations of this construction are possible: for example the shutter actuator may be mounted for a movement of translation instead of a pivoting movement.

We claim:

1. In apparatus for dispensing documents of value, including a housing and a container for a stack of documents, the container being movable along a predetermined path into the housing up to a document feed position, and including a closure device for closing a feed aperture giving access to the stack; the combination of:

a stop member in the housing movable between a first position in which it lies in the path of the container and a second position in which it lies out of the path of the container;

an actuator in the housing, for opening the closure device during insertion of the container into the housing;

means coupling the actuator to the stop member;

the container including means for moving the stop member between its first and second positions such that when the container is inserted, if the closure device is in a closed state the actuator engages and opens the closure device during the insertion and the coupled stop member is in its second position out of the path of the container, and if the closure device is already open the actuator is prevented from such engagement and the coupled stop member is in its first position and prevents full insertion of the container.

2. Apparatus in accordance with claim 1 in which the closure device includes a portion having a recess accessible to the actuator, the means for moving the stop member comprising camming means for engaging the stop member in the housing, when the container reaches a given point during its insertion into the housing, and operative when the closure device is open to move the stop member to its second position clear of the camming means, and to move the coupled actuator into a position in which it enters the recess in the closure device, whereby during further movement of the container into the housing the closure device is moved from its closed position to its open position, the relative position of the camming means and the stop member being such that if the actuator, coupled to the stop member, is prevented from entering the recess, further movement of the container into the housing is blocked by the continued engagement of the stop member and the camming means.

3. Apparatus according to claim 2, in which the coupling means is a bar which is mounted in the housing to pivot about an axis perpendicular to the direction of movement of the container into the housing, and which extends over the path of the container, the actuator lying over the path of the said recess in the closure device, the stop member being mounted on the bar at the side of the path of the container for engagement by the camming means arranged on the side of the container, the actuator entering the recess in the closure device when the bar is pivoted by the engagement of the stop member with the camming means.

4. A container for documents of value, for use in apparatus according to claim 1, and including a closure device so arranged that when the container is in its closed condition, a part of the closure device lies over a feed opening in the front of the container and a further part lies along a face of the container perpendicular to the front opening, the further part including a recess accessible to and engageable by an external member to open the closure device, the container further comprising camming means formed at an outer surface of the container.

5. A container according to claim 4, comprising a cocking mechanism controlled by a lock, the mechanism in one condition preventing the closure device from opening when the lock is in a first position and moving to a second condition to allow the shutter to open when the lock is in a second position, the mechanism being such that the closure device cannot be reopened, after a further closure, without a further operation of the lock.

6. A container in accordance with claim 4, further comprising a lid for closing a top opening of the container, through which a stack of documents can be loaded into the container, the lid being formed with a slot giving access to the said further part of the closure device containing the recess.

7. A container according to claim 6, in which the closure device is an articulated shutter which is so arranged that when it is retracted to its fully open position, it is supported by the lid, and when extended to the closed position, runs in shutter tracks alongside the feed aperture and locks the lid to the container.

8. A container in accordance with claim 7, including means preventing movement of the closure device away from its retracted position in the lid when the lid is open and permitting such movement when the lid is closed.

* * * * *